US011479401B2

(12) United States Patent
Yin et al.

(10) Patent No.: US 11,479,401 B2
(45) Date of Patent: Oct. 25, 2022

(54) CUSHIONING DEVICE AND PACKAGING ASSEMBLY FOR BASE STATION ANTENNA

(71) Applicant: CommScope Technologies LLC, Hickory, NC (US)

(72) Inventors: Hua Yin, Suzhou (CN); Hong Ye, Suzhou (CN); Ying Zhang, Suzhou (CN); HongJun Qian, Suzhou (CN); Keyun Di, Suzhou (CN); Yinqin Shao, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 52 days.

(21) Appl. No.: 16/909,069

(22) Filed: Jun. 23, 2020

(65) Prior Publication Data

US 2021/0024269 A1 Jan. 28, 2021

(30) Foreign Application Priority Data

Jul. 22, 2019 (CN) ..... 201921154834.2

(51) Int. Cl.
*B65D 81/05* (2006.01)
*B65D 85/68* (2006.01)

(52) U.S. Cl.
CPC ..... *B65D 81/052* (2013.01); *B65D 85/68* (2013.01); *B65D 2585/6835* (2013.01)

(58) Field of Classification Search
CPC ..... B65D 81/03; B65D 81/05; B65D 81/052; B65D 85/68; B65D 2585/6835; B65D 81/051
USPC ..... 206/320, 521, 522
See application file for complete search history.

(56) References Cited

U.S. PATENT DOCUMENTS 3,135,390 A * 6/1964 Maro ..... H01Q 1/1207 211/70.1
4,155,453 A * 5/1979 Ono ..... B65D 81/052 206/522
4,872,558 A * 10/1989 Pharo ..... B65D 81/03 206/522
4,874,093 A * 10/1989 Pharo ..... B65D 81/03 206/522

(Continued)

FOREIGN PATENT DOCUMENTS

CN 203419418 U * 2/2014 ..... B65D 81/05
CN 203638406 U 6/2014

(Continued)

OTHER PUBLICATIONS

Extended European Search Report dated Feb. 14, 2022, for corresponding European Application No. 20843711.1 (7 pages).

(Continued)

*Primary Examiner* — Bryon P Gehman
(74) *Attorney, Agent, or Firm* — Myers Bigel, P.A.

(57) ABSTRACT

A cushioning device and a packaging assembly for a base station antenna includes an inner cushioning member and an outer cushioning member. Each cushioning member comprises an inflated airbag. The inner cushioning member is configured to abut an end cover of the housing of the base station antenna and to surround at least one protruding member that is provided on the end cover within a cavity defined by the inner cushioning member. The outer cushioning member is configured to cover both ends of the base station antenna.

19 Claims, 6 Drawing Sheets

(56) References Cited

U.S. PATENT DOCUMENTS

| | | | | | |
|---|---|---|---|---|---|
| 4,905,835 | A * | 3/1990 | Pivert | B65D 81/052 206/522 |
| 5,348,157 | A * | 9/1994 | Pozzo | B65D 81/052 206/522 |
| 5,909,806 | A * | 6/1999 | Fischel | A45C 11/00 206/320 |
| 7,293,647 | B2 * | 11/2007 | Wong | G11B 33/0433 206/307.1 |
| 7,775,021 | B2 * | 8/2010 | Lin | B65D 81/113 53/445 |
| 8,286,796 | B2 * | 10/2012 | Yu | B65D 81/113 206/320 |
| 8,714,356 | B2 | 5/2014 | Liao et al. | |
| 9,718,597 | B2 * | 8/2017 | Itabashi | B65D 81/05 |
| 10,118,752 | B2 * | 11/2018 | Itabashi | B65D 81/055 |
| 2006/0278554 | A1 | 12/2006 | Tanaka et al. | |
| 2016/0207687 | A1 | 7/2016 | Itabashi | |
| 2019/0144190 | A1 | 5/2019 | Zhang et al. | |

FOREIGN PATENT DOCUMENTS

| | | | | |
|---|---|---|---|---|
| CN | 207497308 | U * | 6/2018 | B65D 85/68 |
| JP | 11310268 | A * | 11/1999 | |
| JP | H11310268 | A | 11/1999 | |
| KR | 1020180046230 | A | 5/2018 | |

OTHER PUBLICATIONS

PCT Written Opinion of the International Searching Authority and PCT International Search Report, dated Jun. 22, 2020, in corresponding PCT International Patent Application No. PCT/US2020/020774.

* cited by examiner

CUSHIONING DEVICE AND PACKAGING ASSEMBLY FOR BASE STATION ANTENNA

CROSS-REFERENCE TO RELATED APPLICATION

The present application claims priority to Chinese Patent Application No. 201921154834.2, filed Jul. 22, 2019, the entire content of which is incorporated herein by reference as if set forth fully herein

FIELD

The present disclosure relates to the field of packaging and transportation of base station antennas.

BACKGROUND

Base station antennas are widely used in cellular communications systems. The base station antennas are used to transmit RF signals to users and to receive RF signals from users, thereby realizing the transmission of information.

As shown in FIG. 1, a base station antenna may generally comprise a housing 1 and electronic elements (such as patch, dipole or crossed dipole radiating elements, which are not shown in FIG. 1) accommodated within the housing 1. At least one end cover 2 of the housing 1 is typically provided with a plurality of protruding elements 3 (e.g., interface elements or connector ports for connecting with various cables) that protrude outwardly from the end cover 2. During the transportation of the base station antenna, some cushioning devices may be needed to protect the electronic elements within the base station antenna and the protruding elements 3 provided on the end cover 2.

Currently, in order to protect the base station antenna, foams and/or cushions made of Expandable Polyethylene (EPE) materials are typically used. Then the base station antenna along with foams and/or cushions are placed in a carton for transportation.

SUMMARY

It is an object of the present disclosure to solve one or more of above-described problems and other problems, and to achieve additional advantages.

In a first aspect of the present disclosure, a cushioning device for a base station antenna is provided. The base station antenna comprises a housing and at least one protruding element provided on an end cover of the housing. The cushioning device comprises an inner cushioning member and an outer cushioning member. Each of the inner cushioning member and the outer cushioning member comprises an inflated airbag. The inner cushioning member is configured to abut the end cover and surround the at least one protruding member provided on the end cover within a cavity defined by the inner cushioning member. The outer cushioning member is configured to cover at least both ends of the base station antenna.

According to an embodiment of the present disclosure, the cushioning device further comprises a bottom cushioning member in the form of an inflated airbag, wherein the bottom cushioning member is configured to be placed below the base station antenna.

According to an embodiment of the present disclosure, the cushioning device further comprises at least one middle cushioning member in the form of an inflated airbag, wherein the at least one middle cushioning member is configured to be placed between opposed ends of the base station antenna.

According to an embodiment of the present disclosure, the at least one middle cushioning member comprises a U-shaped inflated airbag.

According to an embodiment of the present disclosure, the inner cushioning member comprises a U-shaped inflated airbag.

According to an embodiment of the present disclosure, the inner cushioning member comprises a cylindrical inflated airbag having a rectangular cross section and at least one open end.

According to an embodiment of the present disclosure, the at least one protruding element comprises a plurality of protruding elements, and the inner cushioning member comprises an inner cushioning member body provided with a notch to avoid interference of the inner cushioning member body with one or more of the plurality of protruding elements.

According to an embodiment of the present disclosure, the outer cushioning member comprises first and second cap-shaped inflated airbags.

According to an embodiment of the present disclosure, each of the cap-shaped inflated airbags includes a cushioning reinforcing member.

According to an embodiment of the present disclosure, each of the cap-shaped inflated airbags comprises an outer cushioning member body, and the cushioning reinforcing member is constructed in one piece with the outer cushioning member body.

According to an embodiment of the present disclosure, each cushioning reinforcing member is configured in a multiple-folding and one-step-shaping structure.

According to an embodiment of the present disclosure, the outer cushioning member comprises a cushioning base and a cushioning cover, wherein the cushioning base is configured to support the entire base station antenna thereon, and the cushioning cover is configured to cover the whole base station antenna.

According to an embodiment of the present disclosure, the cushioning base comprises a bottom portion and two side edges projecting upward from the bottom portion, wherein the two side edges are spaced apart from each other, such that the base station antenna is configured to be supported on the two side edges while one or more mounting elements provided on a bottom plate of the base station antenna are configured to be suspended between the two side edges.

According to an embodiment of the present disclosure, the cushioning device further comprises a support cushioning member, wherein the support cushioning member is configured to be placed in an area of the end cover where there are no protruding elements and is configured to abut the end cover.

According to an embodiment of the present disclosure, the inner cushioning member is enclosed within the outer cushioning member.

According to an embodiment of the present disclosure, the cushioning device is provided with at least one gas access port.

According to an embodiment of the present disclosure, the cushioning device is configured to meet the international safe transit association 2A&3E packaging inspection standards.

In a second aspect of the present disclosure, a packaging assembly for a base station antenna is provided. The packaging assembly comprises an outer package and a cushioning device according to the present disclosure.

In a third aspect of the present disclosure, a cushioning device for a base station antenna is provided. The base station antenna comprises a housing and a plurality of connectors that protrude from an end cover of the housing. The cushioning device comprises an outer cushioning member that substantially encloses the base station antenna and a shrink film or a wrapping film that is wrapped around the outer cushioning member.

According to an embodiment of the present disclosure, the cushioning device further comprises an inner cushioning member that is enclosed within the outer cushioning member.

According to an embodiment of the present disclosure, the inner cushioning member comprises an inflated airbag.

According to an embodiment of the present disclosure, the inner cushioning member is configured to abut the end cover and surround at least some of the connectors within a cavity defined by the inner cushioning member.

According to an embodiment of the present disclosure, the inner cushioning member includes a top wall and two side walls.

According to an embodiment of the present disclosure, the inner cushioning member comprises a cylindrical inflated airbag having a rectangular cross section and at least one open end.

According to an embodiment of the present disclosure, the outer cushioning member comprises a cushioning base and a cushioning cover, wherein the cushioning base is configured to support the entire base station antenna thereon, and the cushioning cover is configured to cover the whole base station antenna.

According to an embodiment of the present disclosure, the cushioning base comprises a bottom portion and two side edges projecting upward from the bottom portion, wherein the two side edges are spaced apart from each other, such that the base station antenna is configured to be supported on the two side edges while one or more mounting elements provided on a bottom plate of the base station antenna are configured to be suspended between the two side edges.

According to an embodiment of the present disclosure, cushioning device further comprises a support cushioning member, wherein the support cushioning member is configured to be placed in an area of the end cover where there are no connectors and is configured to abut the end cover.

DETAILED DESCRIPTION

Figure 1:
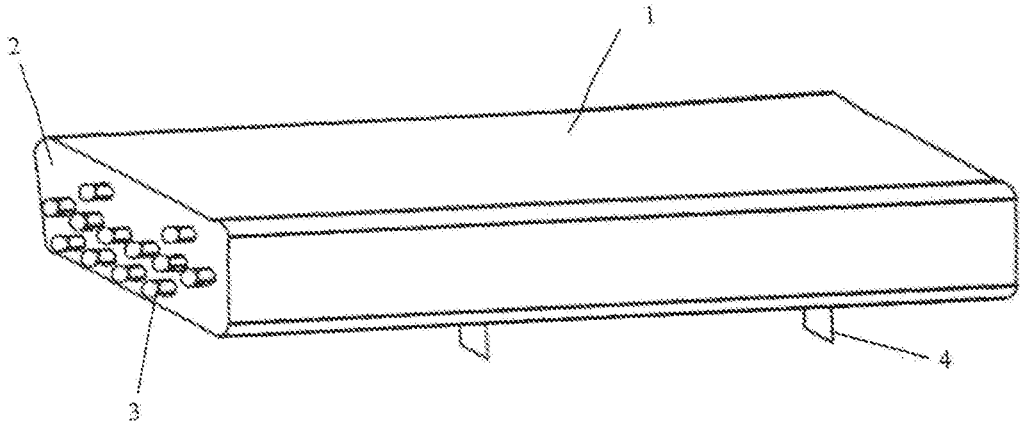
FIG. 1 is a schematic view of a base station antenna.

The present disclosure will be described below with reference to the drawings, in which several embodiments of the present disclosure are shown. It should be understood, however, that the present disclosure may be presented in multiple different ways, and not limited to the embodiments described below. In fact, the embodiments described hereinafter are intended to make a more complete disclosure of the present disclosure and to adequately explain the protection scope of the present disclosure to a person skilled in the art. It should also be understood that, the embodiments disclosed herein can be combined in various ways to provide more additional embodiments.

It should be understood that terms in the specification are only used for describing particular embodiments and are not intended to define the present disclosure. All the terms used in the specification (including the technical terms and scientific terms) have the meanings as normally understood by a person skilled in the art, unless otherwise defined. For the sake of conciseness and/or clarity, the well-known functions or constructions may not be described in detail any longer. The singular forms "a/an", "said" and "the" as used in the specification, unless clearly indicated, all contain the plural forms. The terms "comprising", "encompassing" and "containing" used in the specification indicate the presence of the claimed features, but do not preclude the presence of one or more other features.

Conventional methods of transporting base station antennas in cartons containing foam and/or EPE cushions have various disadvantages. Foam and EPE materials are expensive, which increases the cost of the base station antenna; foam and EPE materials may occupy a large storage space, which is unfavorable for their transportation and recycling; and the carton typically is not waterproof, so that the performance of the base station antenna may be impaired due to water ingress into the packaging material.

The present disclosure provides a cushioning device for protecting a base station antenna during transportation thereof. The cushioning device according to the present disclosure may comprise an inner cushioning member and an outer cushioning member, and each of the inner cushioning member and the outer cushioning member may have a preformed structure formed by an inflatable airbag. The inner cushioning member may be configured to abut an end cover of the housing of the base station antenna and to surround protruding elements provided on the end cover within a cavity defined by the inner cushioning member, so as to protect the protruding elements and to prevent the protruding elements from contacting and damaging the outer cushioning member. The outer cushioning member may be configured to cover both ends of the base station antenna or to cover the entire base station antenna, so as to reduce the forces imparted to the base station antenna during transportation from vibrations or direct impact with other things (e.g., if the base station antenna is dropped while being handled). The cushioning device according to the present disclosure may meet the international safe transit association 2A&3E packaging inspection standards. Specific structures of the cushioning device according to the present disclosure will be described in detail below with reference to FIGS. 2 to 7.

Figure 2:
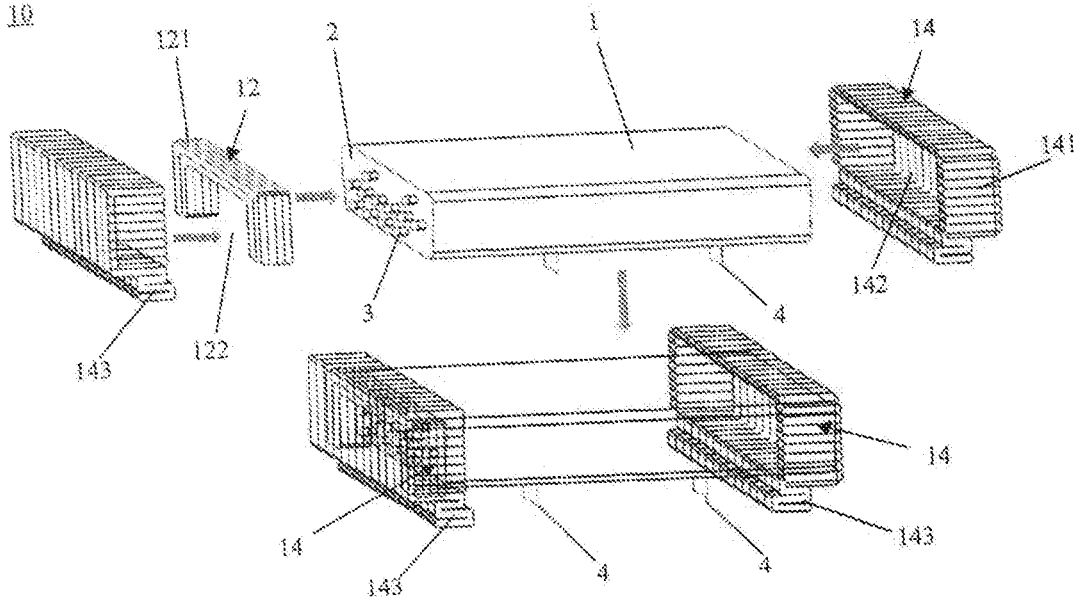
FIG. 2 shows a cushioning device for a base station antenna according to one embodiment of the present disclosure.

With reference to FIG. 2, a cushioning device 10 according to one embodiment of the present disclosure is shown. The cushioning device 10 may comprise an inner cushioning member 12 and an outer cushioning member 14. Each of the inner cushioning member 12 and the outer cushioning member 14 has a preformed structure formed by an inflatable airbag. The inner cushioning member 12 may be configured in a U-shaped structure including an inner cushioning member body 121 and a through cavity 122 surrounded by the inner cushioning member body 121. When the inner cushioning member 12 is mounted onto the base station antenna, the inner cushioning member body 121 may abut the outer surface of the end cover 2 and surround the protruding elements 3 provided on the end cover 2 within the cavity 122, so as to protect the protruding elements 3 and prevent the protruding elements 3 from contacting and damaging the outer cushioning member 14. The protruding elements 3 may be connectors projecting from the end cover 2 of the housing 1. The outer cushioning member 14 may be configured in a cap-shaped structure including an outer cushioning member body 141 and a cavity 142 surrounded by the outer cushioning member body 141 and having a bottom. When the outer cushioning member 14 is mounted onto the base station antenna, the end portion of the base station antenna and the inner cushioning member 12 are both placed in the cavity 142 of the outer cushioning member 14. In this way, the outer cushioning member body 141 may surround the end portion of the base station antenna, not only protecting the outer peripheral surfaces and the end surface of the base station antenna, but also realizing the cushioning function. In addition, the outer cushioning member 14 configured in a cap-shaped structure is waterproof, which may prevent water from entering the interior of the base station antenna via certain gaps in the end of the base station antenna.

In order to strengthen the cushioning effect of the outer cushioning member 14, the outer cushioning member 14 may further comprise a cushioning reinforcing member 143. The cushioning reinforcing member 143 may be configured in a multiple-folding and one-step-shaping structure. The cushioning reinforcing member 143 may be formed by multiple folding of the inflatable airbag. The cushion reinforcing member 143 may be constructed in one piece with the outer cushioning member body 141. In addition, since several mounting elements 4 for mounting and fixing the base station antenna are usually provided on the bottom plate of the base station antenna, in order to avoid transmission of vibration via these mounting elements 4, the thickness of the cushioning reinforcing member 143 may be selected to support the base station antenna at a sufficient distance above the ground or an outer package so that the mounting elements 4 do not contact the ground or the outer package.

Figure 3A:
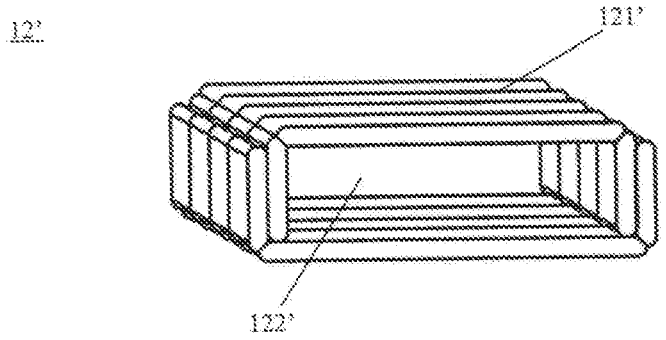
FIGS. 3*a* and 3*b* show two modified embodiments of an inner cushioning member of the cushioning device according to the present disclosure, respectively.
Figure 3B:
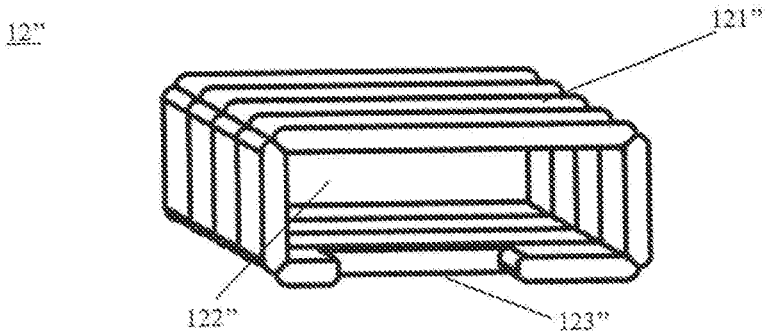

The inner cushioning member 12 and the outer cushioning member 14 may have any suitable configurations depending on actual conditions. FIGS. 3*a* and 3*b* show two modified embodiments of the inner cushioning member of the cushioning device according to the present disclosure, respectively. In the embodiment shown in FIG. 3*a*, the inner cushioning member 12' may be configured in a cylindrical structure having a rectangular cross section, which comprises an inner cushioning member body 121' and a rectangular through cavity 122' surrounded by the inner cushioning member body 121'. Similar to the inner cushioning member 12, when the inner cushioning member 12' is mounted onto the base station antenna, the inner cushioning member body 121' may abut the outer surface of the end cover 2 and surround the protruding elements 3 provided on the end cover 2 within the rectangular cavity 122'. The inner cushioning member 12" shown in FIG. 3*b* has a structure similar to the inner cushioning member 12' shown in FIG. 3*a*, except that a notch 123" is provided in the inner cushioning member body 121" of the inner cushioning member 12". When the inner cushioning member 12" is mounted onto the base station antenna, the notch 123" may be used to keep the inner cushioning member body 121" clear from some protruding elements 3 provided on the end cover 2 of the base station antenna that cannot be accommodated in the rectangular space 122", so as to avoid the interference of the inner cushioning member body 121" with the protruding elements 3.

Figure 4:
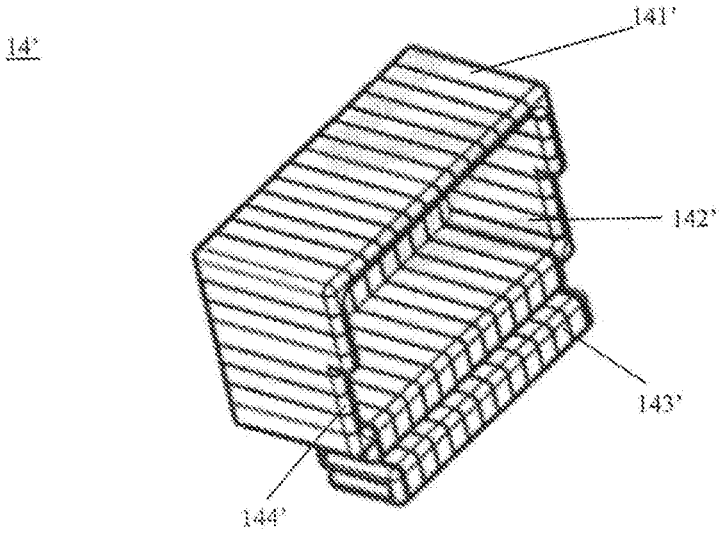
FIG. 4 shows one modified embodiment of an outer cushioning member of the cushioning device according to the present disclosure.

FIG. 4 shows one modified embodiment of the outer cushioning member of the cushioning device according to the present disclosure. The outer cushioning member 14' shown in FIG. 4 has a structure similar to the outer cushioning member 14 shown in FIG. 2, which may be configured in a cap-shaped structure and may comprise an outer cushioning member body 141', a cavity 142' surrounded by the outer cushioning member body 141' and having a bottom, and a cushioning reinforcing member 143'. The outer cushioning member 14' shown in FIG. 4 further comprises a recess 144' provided on the outer cushioning member body 141'. When the outer cushioning member 14' is mounted onto the base station antenna, the recess 144' is used to keep the outer cushioning member body 141' clear from some members provided on the outer circumferences of the base station antenna, so as to avoid the interference of the outer cushioning member body 141' with these members.

After the cushioning device according to the present disclosure is mounted onto the base station antenna, the base station antenna may be directly placed in a conventional package for transportation, such as a carton or a box made of other materials.

Figure 5:
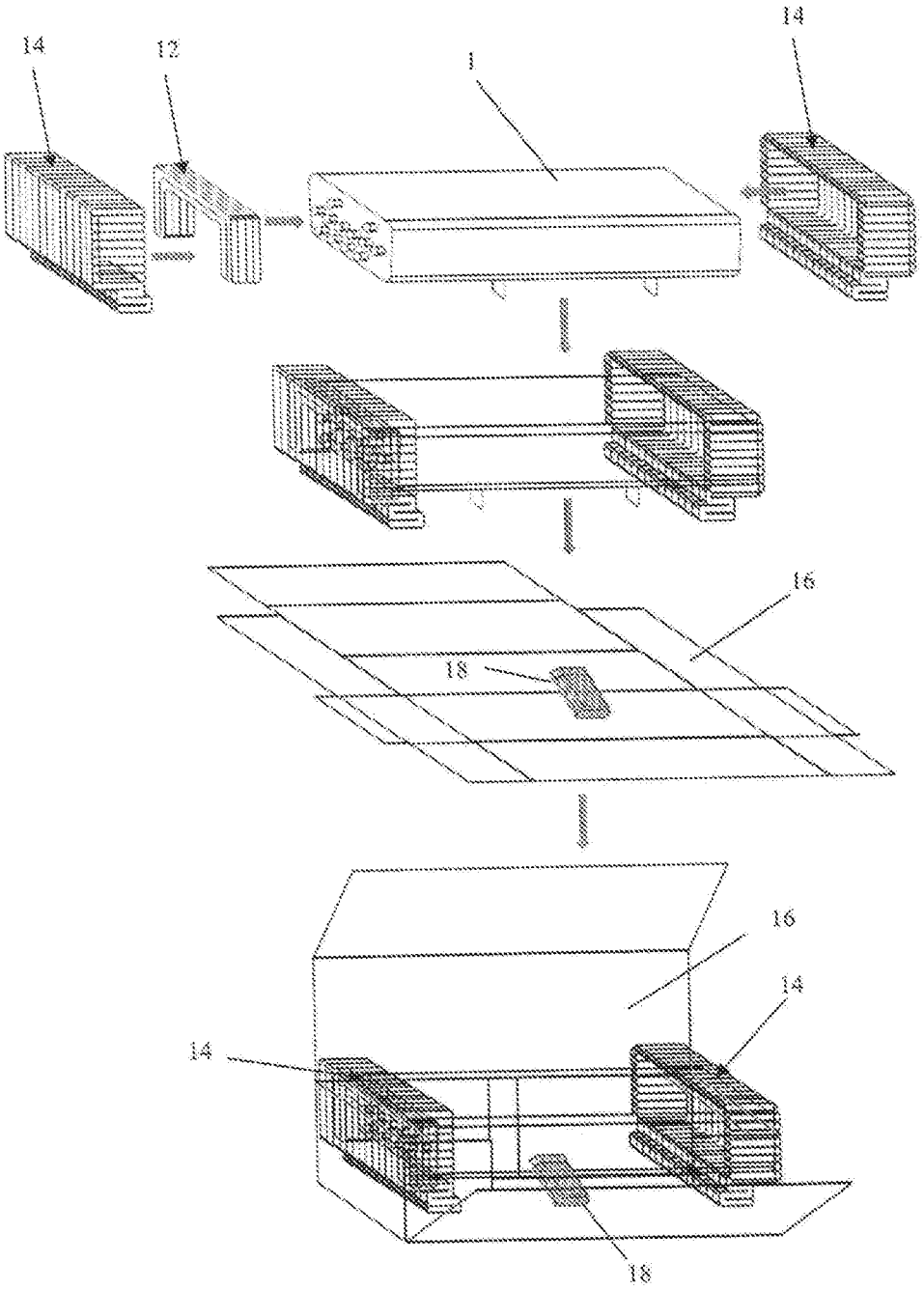
FIG. 5 shows detailed steps of assembling the cushioning device shown in FIG. 2 onto a base station antenna and packaging the latter with a package.

FIG. 5 shows detailed steps of mounting the cushioning device according to the present disclosure onto the base station antenna and packaging the latter with a conventional package. As shown in FIG. 5, the following steps are implemented during the packaging: 1) placing the inner cushioning member 12 around the protruding elements 3 of the end cover 2 of the base station antenna, such that the inner cushioning member body 121 of the inner cushioning member 12 abuts the outer surface of the end cover 2 and the protruding elements 3 are accommodated within the cavity 122; 2) mounting the outer cushioning member 14 at each end of the base station antenna, such that each end of the base station antenna as well as the inner cushioning member 12 are placed in the cavity 142 of the outer cushioning member 14; and 3) placing the base station antenna mounted with the inner cushioning member 12 and the outer cushioning member 14 in the outer package 16 for packaging.

As shown in FIG. 5, in order to further strengthen the damping effect, the cushioning device according to the present disclosure may further comprise a bottom cushioning member 18 placed in a gap between the bottom of the base station antenna and the package 16, so as to reduce impacts suffered by the base station antenna and its internal parts due to longitudinal vibrations during the transportation. The bottom cushioning member 18 may be a solid structure formed by an inflatable airbag, in other words, the bottom cushioning member 18 may not have a cavity.

Figure 6:
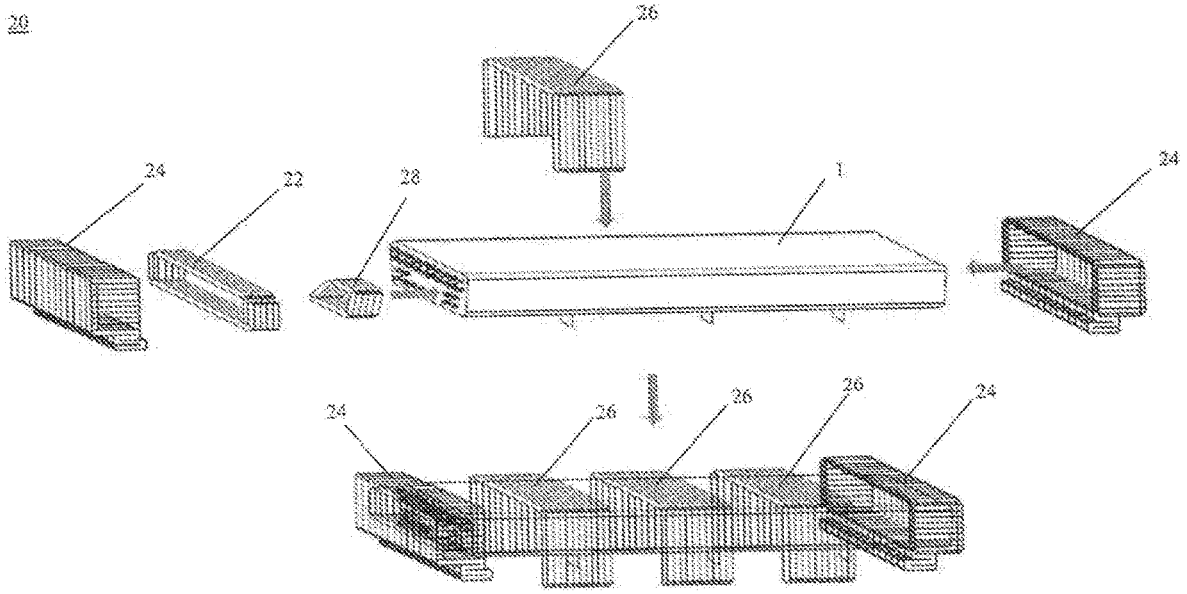
FIG. 6 shows a cushioning device according to another embodiment of the present disclosure.

FIG. 6 shows a cushioning device 20 according to another embodiment of the present disclosure. The cushioning device 20 may comprise an inner cushioning member 22, an outer cushioning member 24, and at least one middle cushioning member 26. Each of the inner cushioning member 22 and the outer cushioning member 24 may have the same configuration and function as any of the inner cushioning members 12, 12' and 12" and the outer cushioning members 14 and 14' shown in FIGS. 2 to 4, respectively. The middle cushioning member 26 may be configured to be placed between two ends of the base station antenna, so as to further strengthen the cushioning effect of the cushioning device 20. Each middle cushioning member 26 may be configured in a U-shaped structure to facilitate mounting to the base station antenna. In addition, the cushioning device 20 may further comprise a small support cushioning member 28. The support cushioning member 28 may be configured to be placed in an area of the end cover where there are no protruding elements 3 and be configured to abut the end cover in this area. The support cushioning member 28 may further protect the protruding elements 3 provided on the end cover along with the inner cushioning member 22 and prevent the protruding elements 3 from contacting and damaging the outer cushioning member 24. Similarly, after the cushioning device 20 is mounted onto the base station antenna, the base station antenna may be directly placed in a conventional package for transportation, such as a carton or a box made of other materials.

Figure 7:
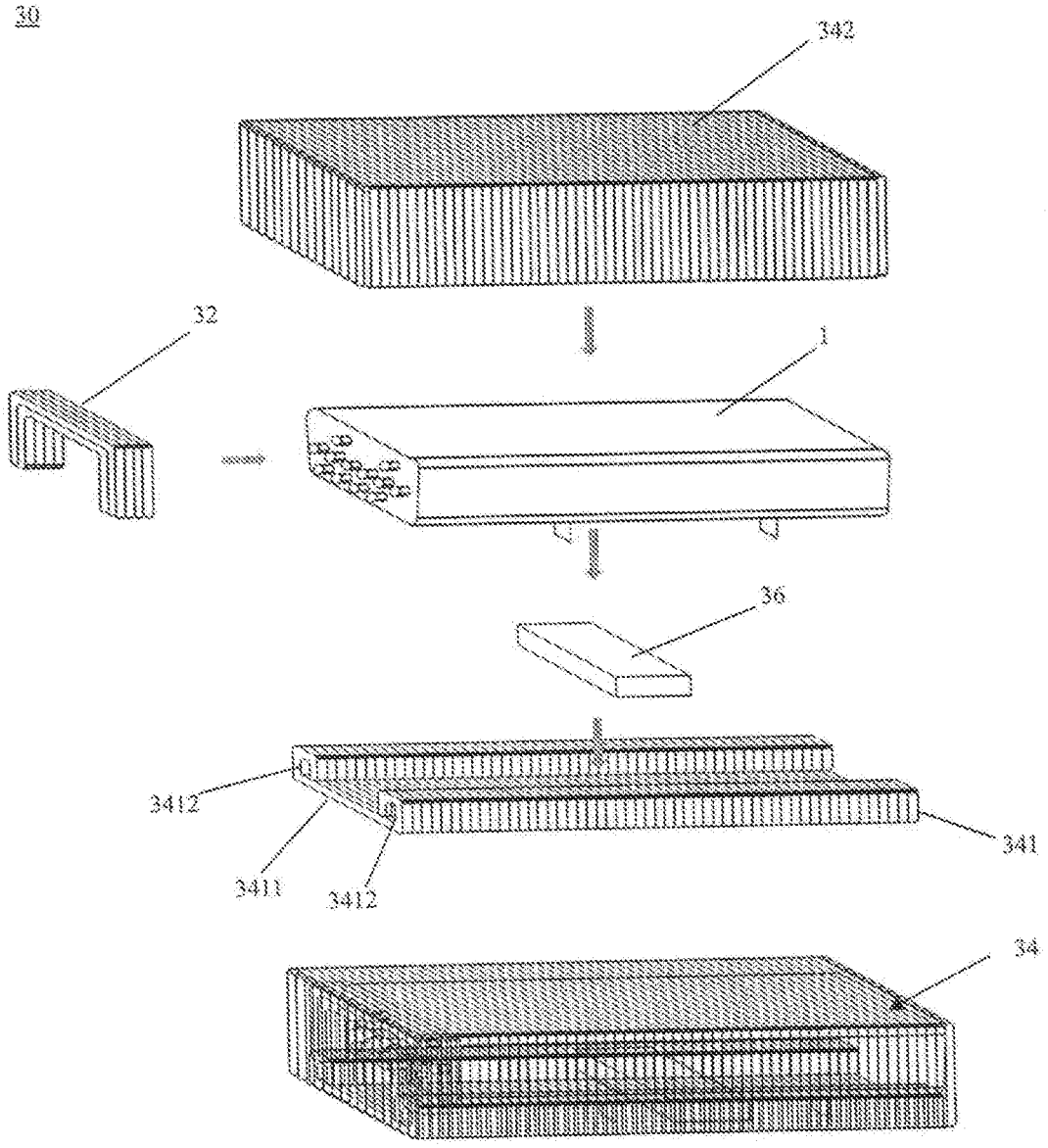
FIG. 7 shows a cushioning device according to a further embodiment of the present disclosure.

FIG. 7 shows a cushioning device 30 according to a further embodiment of the present disclosure. The cushioning device 30 may comprise an inner cushioning member 32 and an outer cushioning member 34. The inner cushioning member 32 may have the same configuration and function as any of the inner cushioning members 12, 12' and 12" shown in FIGS. 2, 3*a* and 3*b*, while the outer cushioning member 34 may be configured to cover the entire base station antenna. Specifically, the outer cushioning member 34 may comprise a cushioning base 341 for placing the base station antenna thereon and a cushioning cover 342 for covering the base station antenna. Each of the cushioning base 341 and the cushioning cover 342 may have a preformed structure formed by an inflatable airbag, and the cushioning base 341 and the cushioning cover 342 may be sized to accommodate the whole base station antenna in a space formed by them. The cushioning base 341 may comprise a bottom portion 3411 and two side edges 3412 that project upwardly from the bottom portion 3411. The two side edges 3412 may be spaced apart by a distance, such that the base station antenna may be supported on the two side edges 3412, while the mounting elements 4 provided on the bottom plate of the base station antenna may be suspended between the two side edges 3412. Additionally, the distance between the two side edges 3412 may also be chosen to place a box 36 that includes mounting hardware for the base station antenna between the two side edges 3412 such that the ends of the box 36 may contact the respective side edges 3412, and thus the box 36 may not move during transportation of the base station antenna.

The cushioning device 30 shown in FIG. 7 covers the whole base station antenna, and thus may provide an improved cushioning effect and waterproof effect to the base station antenna. After the entire base station antenna is placed in the outer cushioning member 34 of the cushioning device 30, it is only necessary to envelope the outer cushioning member 34 with a shrink film or a wrapping film before transporting the base station antenna, eliminating any need for a conventional package such as a carton.

Figure 8:
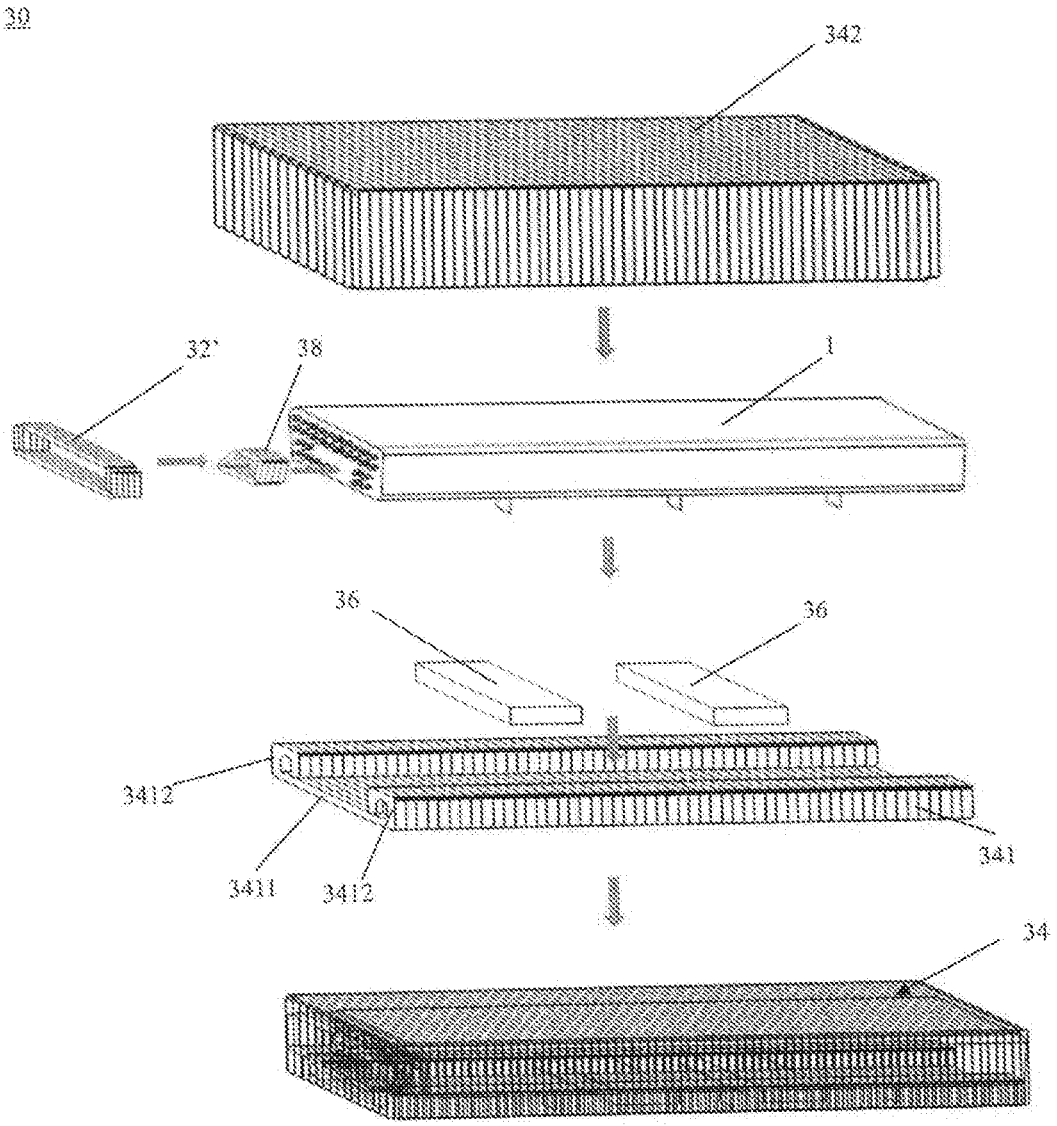
FIG. 8 shows a variant of the cushioning device of FIG. 7.

FIG. 8 shows a variant of the cushioning device 30 shown in FIG. 7. The inner cushioning member 32' of the cushioning device 30 shown in FIG. 8 is configured in a cylindrical structure having a rectangular cross section, and the cushioning device 30 shown in FIG. 8 further comprises a small support cushioning member 38. Similar with the support cushioning member 28 shown in FIG. 6, the cushioning member 38 may be configured to be placed in an area of the end cover where there are no protruding elements 3 and be configured to abut the end cover in this area. The support cushioning member 38 may protect the protruding elements 3 provided on the end cover along with the inner cushioning member 32' and prevent the protruding elements 3 from contacting and damaging the outer cushioning member 34.

Various embodiments of the cushioning device according to the present disclosure as well as its members have been described in detail above in combination with the accompanying drawings. The cushioning devices according to various embodiments of the present disclosure can all meet the international safe transit association 2A&3E packaging inspection standards. In various embodiments according to the present disclosure, the material of the airbag is a coextruded film of PA (nylon) and PE (low density polyethylene). When various cushioning members are formed into a preformed structure with an airbag, the corners may be reduced in an air-column-point-pressure manner, so as to diminish the outer dimensions of various cushioning members.

In addition, although not shown in the drawings, the inner cushioning member, the outer cushioning member, each of the bottom cushioning member, the middle cushioning member, and the support cushioning member of the cushioning device according to the present disclosure may be provided with at least one gas access port. When the cushioning device according to the present disclosure is to be used, each cushioning member of the cushioning device will be filled with gas via the gas access port; and when the cushioning device according to the present disclosure is not in use, the gas may be vented from each cushioning member of the cushioning device via the gas access port. Such a configuration may allow the cushioning device according to the present disclosure to occupy a small space when the cushioning device is not in use, and thus facilitate its storage before use and facilitate its recovery after use.

The cushioning device according to the present disclosure may protect the base station antenna with various cushioning members (for example, an outer cushioning member, an inner cushioning member, a bottom cushioning member, at least one middle cushioning member, a support cushioning member, etc.) formed of an inflatable airbag, so as to reduce the likelihood that electronic elements within the base station antenna and/or protruding elements provided on the end cover of the base station antenna are damaged by vibration or shock during transportation. Compared with a conventional cushioning device, the cushioning device according to the present disclosure has the following advantages: it has a favorable damping effect so that it may meet the international safe transit association 2A&3E packaging inspection standards; it is low cost; it may be stored and reused conveniently, since it may only occupy a small space in a non-inflated condition; and it has a favorable waterproof function.

Although the exemplary embodiments of the present disclosure have been described, a person skilled in the art should understand that, he or she can make multiple changes and modifications to the exemplary embodiments of the present disclosure without departing from the spirit and scope of the present disclosure. Accordingly, all the changes and modifications are encompassed within the protection scope as defined by the claims of the present invention.

That which is claimed is:

1. A cushioning device for a base station antenna, wherein the base station antenna comprises a housing having opposing end covers and at least one protruding element provided on one of the end covers of the housing, the cushioning device comprising:

an inner cushioning member that comprises a first inflated airbag; and a first outer cushioning member and a second outer cushioning member, each outer cushioning member comprising a respective second inflated airbag, wherein the inner cushioning member is configured to engage the end cover with the at least one protruding element provided thereon and surround the at least one protruding member within a cavity defined by the inner cushioning member, and wherein the first outer cushioning member is configured to receive at least a portion of the inner cushioning member within a cavity defined by the first outer cushioning member and cover one of the end covers of the housing of the base station antenna and the second outer cushioning member is configured to cover the opposing end cover of the housing of the base station antenna.

2. The cushioning device according to claim 1, wherein the cushioning device further comprises at least one middle cushioning member that comprises a third inflated airbag that is configured to be placed between opposed ends of the base station antenna.

3. The cushioning device according to claim 2, wherein the at least one middle cushioning member comprises a U-shaped inflated airbag.

4. The cushioning device according to claim 1, wherein the first inflated airbag has a U-shape.

5. The cushioning device according to claim 1, wherein the second inflated airbags of the first and second outer cushioning members are cap-shaped inflated airbags.

6. The cushioning device according to claim 5, wherein each of the first and second cap-shaped inflated airbags includes a respective cushioning reinforcing member.

7. The cushioning device according to claim 6, wherein each of the first and second cap-shaped inflated airbags comprises a respective outer cushioning member body, and the respective cushioning reinforcing member is integral with the respective outer cushioning member body.

8. The cushioning according to claim 6, wherein each cushioning reinforcing member is configured in a multiple-folding and one-step-shaping structure.

9. The cushioning device according to claim 1, wherein the cushioning device further comprises a support cushioning member, wherein the support cushioning member is configured to be placed in an area of one of the end covers where there are no protruding elements and is configured to abut the respective end cover.

10. The cushioning device according to claim 1, wherein the inner cushioning member is enclosed within the first outer cushioning member.

11. The cushioning device according to claim 1, wherein the cushioning device is provided with at least one gas access port.

12. A cushioning device for a base station antenna, wherein the base station antenna comprises a housing and a plurality of connectors that protrude from an end cover of the housing, the cushioning device comprising:

an outer cushioning member that substantially encloses the base station antenna;

an inner cushioning member that is enclosed within the outer cushioning member; and a shrink film or a wrapping film that is wrapped around the outer cushioning member, wherein the outer cushioning member and the inner cushioning member each comprise an inflated airbag.

13. The cushioning device according to claim 12, wherein the inner cushioning member is configured to abut the end cover and surround at least some of the connectors within a cavity defined by the inner cushioning member.

14. The cushioning device according to claim 12, wherein the inner cushioning member includes a top wall and two side walls.

15. The cushioning device according to claim 12, wherein the cushioning device further comprises a support cushioning member, wherein the support cushioning member is configured to be placed in an area of the end cover where there are no connectors and is configured to abut the end cover.

16. A cushioning device for a base station antenna, wherein the base station antenna comprises a housing having opposing end covers and at least one protruding element provided on one of the end covers of the housing, the cushioning device comprising:

an inner cushioning member that comprises a first inflated airbag;

a first outer cushioning member and a second outer cushioning member, each outer cushioning member comprising a second inflated airbag, respectively; and at least one middle cushioning member that comprises a third inflated airbag that is configured to be placed between opposed ends of the base station antenna, wherein the inner cushioning member is configured to engage the end cover with the at least one protruding element provided thereon and surround the at least one protruding member within a cavity defined by the inner cushioning member, and wherein the first outer cushioning member is configured to receive at least a portion of the inner cushioning member within a cavity defined by the first outer cushioning member and cover one of the end covers of the housing of the base station antenna and the second outer cushioning member is configured to cover the opposing end cover of the housing of the base station antenna, wherein the second inflated airbags of the first and second outer cushioning members are cap-shaped inflated airbags.

17. The cushioning device according to claim 16, wherein the at least one middle cushioning member comprises a U-shaped inflated airbag.

18. The cushioning device according to claim 16, wherein the inner cushioning member is enclosed within the first outer cushioning member.

19. The cushioning device according to claim 16, wherein each of the first and second cap-shaped inflated airbags includes a respective cushioning reinforcing member.

* * * * *